United States Patent [19]

Wride et al.

[11] Patent Number: 4,688,284

[45] Date of Patent: Aug. 25, 1987

[54] WAVE DAMPENED WATERBED

[75] Inventors: Lawrence Wride, Ellicott City; Donald W. Keefer, Pasadena, both of Md.

[73] Assignee: Classic Corporation, Baltimore, Md.

[21] Appl. No.: 871,320

[22] Filed: Jun. 6, 1986

[51] Int. Cl.[4] ..... A47C 27/08

[52] U.S. Cl. ..... 5/450; 5/451

[58] Field of Search ..... 5/451, 450, 452, 457, 5/458, 422, 441

[56] References Cited

U.S. PATENT DOCUMENTS

| | | | |
|---|---|---|---|
| 4,145,780 | 3/1979 | Fogel | 5/451 |
| 4,247,962 | 2/1981 | Hall | 5/451 |
| 4,296,510 | 10/1981 | Phillips | 5/451 |
| 4,301,560 | 11/1981 | Fraige | 5/450 |
| 4,399,575 | 8/1983 | Hall | 5/450 |
| 4,411,033 | 10/1983 | Morgan | 5/450 |
| 4,462,128 | 7/1984 | Labianco | 5/451 |
| 4,467,485 | 8/1984 | Hall | 5/450 |
| 4,496,623 | 1/1985 | Fraige | 5/450 |
| 4,523,343 | 6/1985 | Fraige | 5/450 |
| 4,577,356 | 3/1986 | Tomenning et al. | 5/451 |

FOREIGN PATENT DOCUMENTS

| | | | |
|---|---|---|---|
| 1175168 | 9/1984 | Canada | 5/451 |
| 2099296 | 12/1982 | United Kingdom | 5/451 |

OTHER PUBLICATIONS

"INTEX" A full page ad in the Mar. 1986, issue of Waterbed Magazine.

"Bast Rest" A pamphlet of the Royal Model (1981) available from Best Rest Co., 12828 South Broadway, Los Angeles, Calif. 90061.

*Primary Examiner*—Alexander Grosz

*Attorney, Agent, or Firm*—Finnegan, Henderson, Farabow, Garrett & Dunner

[57] ABSTRACT

A wave dampened waterbed mattress includes a bladder for containing water, a first horizontally extending baffle within the bladder having a horizontal extent corresponding generally to the horizontal extent of the top wall, and including flotation material for causing it to float against the top wall of the bladder is filled with water, and a second horizontally extending baffle with in the bladder having a substantial horizontal extent and a density greater than water for causing it to lie against the bottom wall of the bladder. The first and second baffles are free floating, unanchored, and spaced relative to each other to leave a layer of unbaffled water between them. The upper baffle preferably includes a layer of beaded polyester fiber which is joined to a top layer of open cell convoluted foam. The bottom layer preferably includes several layers of unbeaded polyester fiber. The fiber is bonded and non-woven.

7 Claims, 2 Drawing Figures

FIG 1
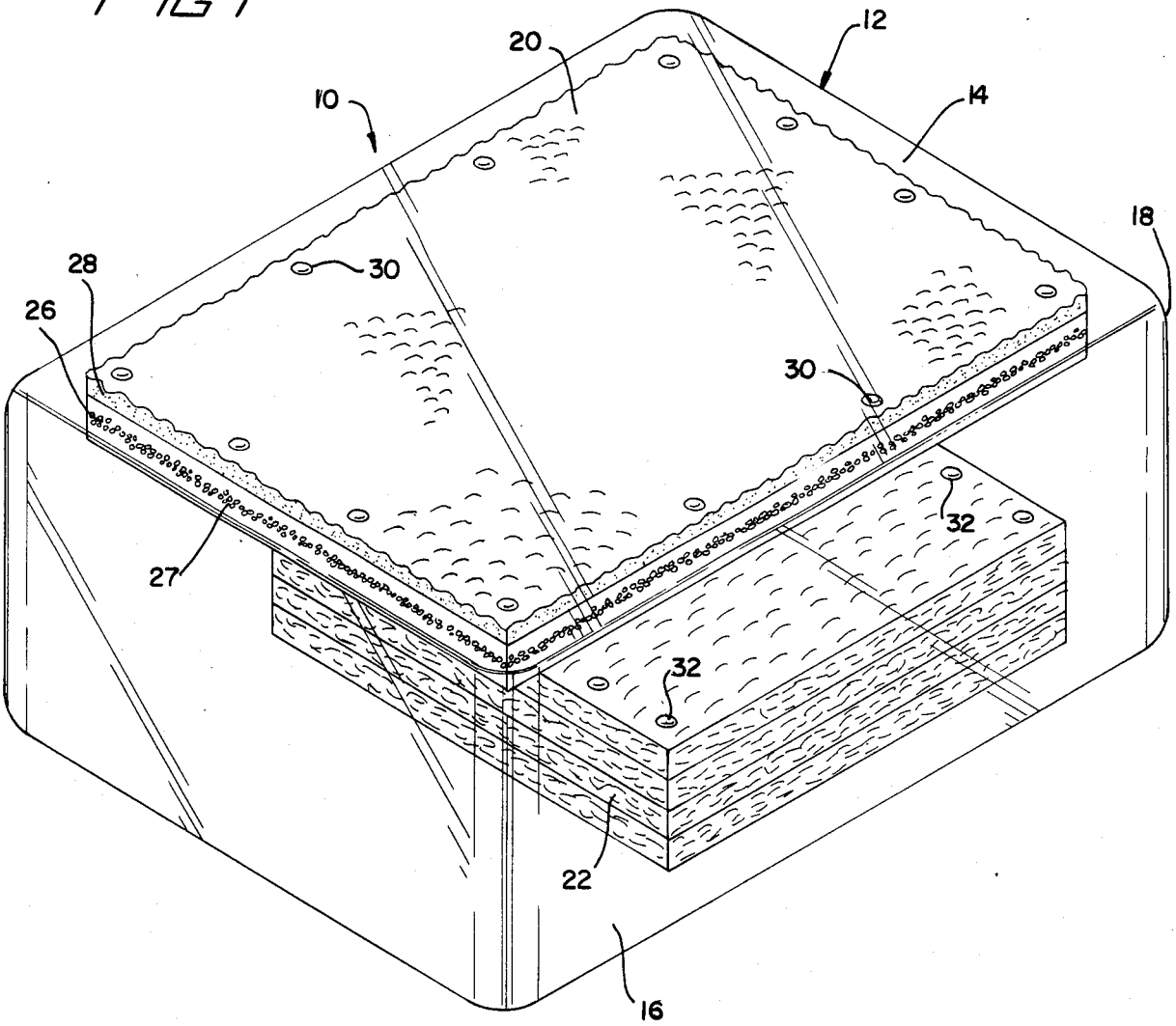
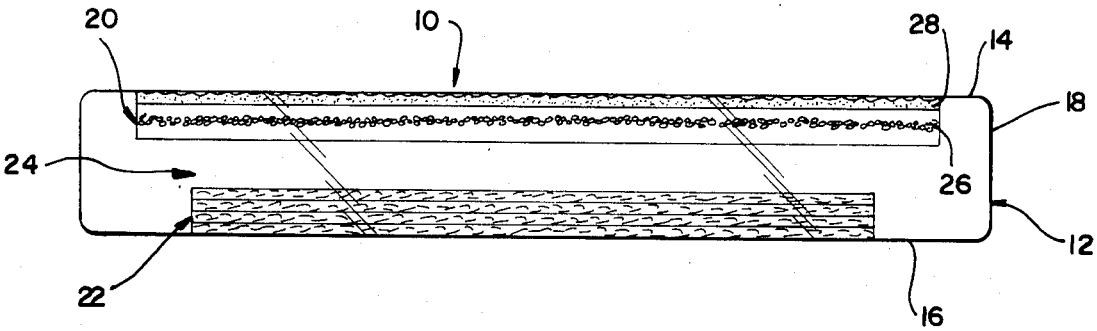
FIG 2

WAVE DAMPENED WATERBED

BACKGROUND OF THE INVENTION

1. Field of the Invention

The present invention relates to a waterbed construction having improved wave dampening properties.

2. Description of the Related Art

Although waterbeds have enjoyed wide popularity in recent years, many consumers have objected to the wave motion in the water within the mattress. Therefore, in the past, many efforts have been made to reduce wave motion in the water within the mattress through different arrangements of foam, fiber, and other baffle materials.

For example, the Ultratherm "second transition mattress used "paratex" which is bonded rubberized horsehair fiber fill. This product was documented in U.S. Pat. No. 4,301,560 to Richard Fraige which disclosed the use of other fibers for wave dampening. U.S. Pat. No. 4,481,248 to Richard Fraige disclosed the use of buoyant fiber product. It is also known that in 1979, Richard LaBianco reduced to practice the use of bonded polyester fiber fill in waterbeds.

However, known baffle arrangements have at least one of the following drawbacks: they provide insufficient wave dampening, they provide wave dampening only after an extended period of time, they are complex or costly to manufacture, they provide an uncomfortable sleep surface, they are bulky to ship assembled as a complete mattress unit, they are difficult to assemble or properly fill with water, and they are difficult to drain after they have been filled with water and are being prepared for a move or storage.

It is an object of the present invention to provide a waterbed with a baffle which provides improved wave dampening.

It is also an object of the present invention to provide a waterbed with a baffle which provides extremely rapid wave dampening.

It is another object of the present invention to provide a waterbed with a baffle which is not complex or costly to manufacture.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, there is provided a wave dampened waterbed mattress comprising: a bladder for containing water, the bladder including a top wall, a bottom wall, and a side wall connecting the top and bottom walls; a first horizontally extending baffle within the bladder, the first baffle having a horizontal extent corresponding generally to the horizontal extent of the top wall, and including means for causing it to float against the top wall of the bladder when the bladder is filled with water; a second horizontally extending baffle within the bladder, the second baffle having a substantial horizontal extent, and a density greater than water for causing it to lie against the bottom wall of the bladder; the first and second baffles being free floating, unanchored, and spaced relative to each other to leave a layer of unbaffled water between the first and second baffles.

It is further preferable that the baffles include at least one layer of fibrous material and that the first baffle includes a layer of convoluted open cell foam as its upper surface for enhancing the feel of the mattress.

BRIEF DESCRIPTION OF THE DRAWINGS

The accompanying drawings, which are incorporated in and constitute a part of the specification, illustrate a preferred embodiment of the invention and, together with the general description given above and the detailed description of the prefered embodiment given below, serve to explain the principles of the invention.

FIG. 1 is a perspective view of a waterbed incorporating the teachings of the present invention; and FIG. 2 is a side elevation view of the waterbed illustrated in FIG. 1.

DESCRIPTION OF THE PREFERRED EMBODIMENT

Reference will now be made in detail to the present preferred embodiment of the invention as illustrated in the accompanying drawings.

In accordance with the present invention there is provided a wave dampened waterbed mattress comprising: a bladder for containing water, the bladder including a top wall, a bottom wall, and a side wall connecting the top and bottom walls; a first baffle having a horizontal extent corresponding generally to the horizontal extent of the top wall, and including means for causing it to float against the top wall of the bladder when the bladder is filled with water; a second horizontally extending baffle within the bladder, the second baffle having a substantial horizontal extent, and a density greater than water for causing it to lie against the bottom wall of the bladder; the first and second baffles being free floating, unanchored, and spaced relative to each other to leave a layer of unbaffled water between the first and second baffles.

As shown in FIGS. 1 and 2, a wave dampened waterbed mattress 10 includes a bladder 12 for containing water, the bladder 12 including a top wall 14, a bottom wall 16 and a side wall 18 connecting top wall 14 and bottom wall 16.

A first horizontally extending baffle 20 is positioned within bladder 12 and has a horizontal extent corresponding generally to the horizontal extent of the top wall. In the illustrated embodiment, the first baffle 20 includes a plurality of polystyrene beads dispersed therein so that it is buoyant and floats against the top wall 14 of the bladder when the bladder is filled with water. Other flotation media such as closed cell foam could also be used to make the first baffle 20 floatable.

A second horizontally extending baffle 22 is positioned within bladder 12. Second baffle 22 has a substantial horizontal extent so that it covers a substantial portion of the bottom wall 16. In the preferred embodiment the second baffle 22 covers approximately $\frac{3}{4}$ of the bottom wall 16 in length and width. Second baffle 22 has a density greater than water so that the second baffle lies against bottom wall 16 of the bladder when the bladder is filled with water.

First baffle 20 and second baffle 22 are free floating in that they are not attached to bladder 12. They are unanchored to each other and spaced relative to each other to leave a layer of unbaffled water 24 between them as best seen in FIG. 2.

First baffle 20 preferably includes a fibrous layer 26 as its lower layer. The fibrous layer is preferably a layer of two ounce beaded fiber which is commercially available. The fiber is a bonded unwoven polyester fiber and the beads 27 are preferably expanded polystyrene material which gives the fiber sufficient buoyancy so that first baffle 20 floats against the top wall of bladder 12 when the bladder is filled with water. The two ounce beaded fiber layer is approximately two inches thick.

A layer of open cell convoluted foam 28 preferably is attached to the upper layer of beaded fiber 26 by rivets 30 to form the upper surface of the first horizontally extending baffle 20. This upper layer of open cell convoluted foam 28 provides a surface which feels more comfortable to a user of the bed than the fibrous material. However, the foam by itself would provide a less satisfactory baffle without a layer of fibrous material such as fibrous layer 26. The layer of open cell convoluted foam 28 is between one and one half to one and three quarters inches thick.

The assembled first horizontally extending layer 20 preferably measures 71 by 83 inches for a king size waterbed and 59 by 83 inches for a queen size waterbed.

Second horizontally extending baffle 22 preferably includes four one ounce blocks of plain unbeaded bonded polyester fiber in an unwoven configuration which is commercially available. The blocks of unbeaded fiber are held together by rivets 32. Each one ounce block of unbeaded fiber is approximately one inch thick thereby making second horizontally extending baffle 22 approximately 4 inches thick.

It is preferable that the second horizontally extending baffle 22 measures 60 by 60 inches for a king size waterbed and 50 by 60 inches for a queen size waterbed. Therefore, it is seen that the horizontal extent of second horizontally extending baffle 22 is preferably less in both directions than first horizontally extending baffle 20.

The two spaced horizonally extending baffles effectively dampen wave motion in the waterbed by confining wave motion to the layer of unbaffled water 24 between the two horizontally extending baffles 20 and 22. In addition, wave motion is not transferred between horizontally extending baffles 20 and 22 because there is no anchoring or tethering arrangement either between the first and second horizontally extending baffles 20 and 22 or between either of the baffles and bladder 12. The baffle system is easy to manufacture since it comprises two basic block units which are separate from each other. The waterbed is also easy to ship and set up because the use of polyester fiber materials allows for compact storage.

Additional advantages and modifications will readily occur to those skilled in the art. The invention in its broader aspects is, therefore, not limited to the specific details, representative apparatus and illustrative examples shown and described. Accordingly, departures may be made from such details without departing from the spirit or scope of applicants general inventive concept.

What is claimed is:

1. A wave dampened waterbed mattress comprising:

a bladder for containing water, the bladder including a top wall, a bottom wall, and a side wall connecting the top and bottom walls;

a first horizontally extending baffle within the bladder, the first baffle having a horizontal extent corresponding generally to the horizontal extent of the top wall, and including means for causing it to float against the top wall of the bladder when the bladder is filled with water, the top surface of said baffle being defined by a convoluted layer of open cell foam;

a second horizontally extending baffle within the bladder, the second baffle having a substantial horizontal extent, and a density greater than water for causing it to lie against the bottom wall of the bladder, said baffle including at least one flexible fibrous layer;

the first and second baffles being free floating, unanchored, spaced and unattached relative to each other.

2. A wave dampened waterbed mattress as claimed in claim 1, wherein the first horizontally extending baffle includes at least one flexible fibrous layer.

3. A wave dampened waterbed mattress as claimed in claim 2 wherein the fibrous layer forms the bottom portion of the first baffle.

4. A wave dampened waterbed mattress as claimed in claim 1 wherein the first baffle includes a fibrous layer having flotation beads for causing buoyancy.

5. A wave dampened waterbed mattress as claimed in claim 1 wherein the fibrous layer constitutes the top surface of the second baffle.

6. A wave dampened waterbed mattress as claimed in claim 1 wherein the second baffle has a lesser horizontal extent than the first baffle in at least one dimension.

7. A wave dampened waterbed mattress as claimed in claim 1 wherein the second baffle has lesser horizontal extent than to the first baffle in both horizontal dimensions.

* * * * *